US010995718B2

(12) United States Patent
Mercer et al.

(10) Patent No.: US 10,995,718 B2
(45) Date of Patent: May 4, 2021

(54) HIGH PRESSURE DIESEL PUMP

(71) Applicant: DELPHI TECHNOLOGIES IP LIMITED, St. Michael (BB)

(72) Inventors: Adam Mercer, Dursley (GB); Ryan Williams, Cheltenham (GB); Andrew Male, Walton on Thames (GB)

(73) Assignee: DELPHI TECHNOLOGIES IP LIMITED

( * ) Notice: Subject to any disclaimer, the term of this patent is extended or adjusted under 35 U.S.C. 154(b) by 250 days.

(21) Appl. No.: 16/096,966

(22) PCT Filed: Apr. 20, 2017

(86) PCT No.: PCT/EP2017/059421
§ 371 (c)(1),
(2) Date: Oct. 26, 2018

(87) PCT Pub. No.: WO2017/186573
PCT Pub. Date: Nov. 2, 2017

(65) Prior Publication Data

US 2020/0325868 A1 Oct. 15, 2020

(30) Foreign Application Priority Data

Apr. 26, 2016 (GB) ..... 1607232

(51) Int. Cl.
*F02M 55/02* (2006.01)
*F02M 59/46* (2006.01)

(52) U.S. Cl.
CPC ..... *F02M 59/462* (2013.01)

(58) Field of Classification Search
CPC ..... F02M 35/10216; F02M 55/005; F02M 55/02; F02M 61/14; F02M 69/462
USPC ..... 123/445, 468–470, 490; 417/299, 559; 251/129.15
See application file for complete search history.

(56) References Cited

U.S. PATENT DOCUMENTS 4,279,573 A 7/1981 Rychlik et al.
4,489,886 A * 12/1984 Kato ..... F02M 57/024 239/124
5,357,944 A 10/1994 Rathmayr
5,373,828 A 12/1994 Askew et al.
5,517,973 A 5/1996 Askew et al.
6,321,999 B1 * 11/2001 Male ..... F02M 57/02 239/96

(Continued)

FOREIGN PATENT DOCUMENTS

CN 103573507 A 2/2014
CN 203548030 U 4/2014

(Continued)

*Primary Examiner* — John Kwon
(74) *Attorney, Agent, or Firm* — Joshua M. Haines

(57) ABSTRACT

A high pressure fuel pump includes a pressurizing assembly where a plunger arranged in a bore translates along a main axis. The pump also includes a fuel transfer assembly having an inlet valve assembly and an outlet valve assembly. The pressurizing assembly has a pressurizing body provided with the bore and the fuel transfer assembly has a fuel transfer body within which are arranged the inlet and the outlet valve assemblies. The pressurizing body and the fuel transfer body are distinct parts fixed to each other along a sealing area.

9 Claims, 4 Drawing Sheets

(56) References Cited

U.S. PATENT DOCUMENTS

| | | | | |
|---|---|---|---|---|
| 8,075,287 | B2 * | 12/2011 | Inoue | F04B 53/162 417/571 |
| 2004/0179963 | A1 * | 9/2004 | Kubota | F02M 59/44 417/470 |
| 2010/0043760 | A1 * | 2/2010 | Crofts | F04B 19/22 123/541 |
| 2010/0226795 | A1 * | 9/2010 | Shaull | F02M 53/00 417/290 |
| 2015/0017035 | A1 | 1/2015 | McCrindle | |
| 2019/0003434 | A1 * | 1/2019 | Langenbach | F02M 63/0021 |
| 2019/0113032 | A1 * | 4/2019 | Garland | F16J 1/006 |
| 2019/0162142 | A1 * | 5/2019 | Kolb | F02M 63/0075 |
| 2020/0182365 | A1 * | 6/2020 | Pellini | F02M 59/442 |
| 2020/0256300 | A1 * | 8/2020 | Perry | F04B 17/05 |

FOREIGN PATENT DOCUMENTS

| | | | |
|---|---|---|---|
| DE | 2651586 | B1 | 4/1978 |
| DE | 102011089857 | A1 | 6/2013 |
| GB | 2269426 | A | 2/1994 |
| JP | 11082236 | A | 3/1999 |
| JP | 2003083201 | A | 3/2003 |

* cited by examiner

HIGH PRESSURE DIESEL PUMP

CROSS REFERENCE TO RELATED APPLICATIONS

This application is a national stage application under 35 USC 371 of PCT Application No. PCT/EP2017/059421 having an international filing date of Apr. 20, 2017, which is designated in the United States and which claimed the benefit of GB Patent Application No. 1607232.4 filed on Apr. 26, 2016, the entire disclosures of each are hereby incorporated by reference in their entirety.

TECHNICAL FIELD

The present invention relates to a fuel injection high pressure fuel pump.

BACKGROUND OF THE INVENTION

Fuel injection equipment's are provided with a high pressure pump adapted to pressurize fuel prior to flowing it to a high pressure reservoir, also known as a common-rail. In diesel equipment's high pressure can be in the ranges above 2000 bars and, the pump withstands internal mechanical stresses, even when running lower than 2000 bars, having high frequency magnitude changes therefore generating fatigue of the pump. Several operational parameters raise the fatigue stresses reaching levels jeopardizing the mechanical integrity of the pump.

SUMMARY OF THE INVENTION

Accordingly, it is an object of the present invention to resolve the above mentioned problems in providing a high pressure fuel pump adapted to be arranged in a diesel fuel injection equipment. The pump comprises a pressurizing assembly wherein a plunger arranged in a bore is adapted to translate along a main axis in order to vary the volume of a compression chamber defined by an extremity of the bore and an extremity of the plunger and, a fuel transfer assembly comprising an inlet valve assembly, controlling an inlet flow of low pressure fuel in said compression chamber and, an outlet valve assembly controlling an outlet flow of pressurized fuel out of said compression chamber.

Moreover, the pressurizing assembly has a pressurizing body provided with the bore and, the fuel transfer assembly has a fuel transfer body wherein are arranged the inlet and the outlet valve assemblies, said pressurizing body and fuel transfer body being distinct parts sealingly fixed to each other along a sealing area.

Also, the sealing area is a compressed surface defined between a pressurizing body sealing face and a fuel transfer body sealing face, at least one of said sealing faces being provided with a sealing interface forming a protrusion raising above said at least one of said sealing faces, the tip of said sealing interface defining the sealing area.

Also, the fuel transfer body sealing face, the pressurizing body sealing face and, the resulting sealing area are planar and perpendicular to the main axis.

Also, the bore opens in the pressurizing body sealing face.

Also, the fuel transfer body sealing face closes the opening of the bore.

Also, the compression chamber has a cylindrical peripheral wall defined by the end portion of the bore that is in the vicinity of the bore opening in the pressurizing body sealing face and, a ceiling defined by the portion of the fuel transfer body sealing face closing the opening of the bore, the sealing area being defined at the periphery of said opening of the bore.

Also, the fuel transfer body is provided with an inlet channel controlled by an inlet valve member, the inlet channel opening into the compression chamber through an inlet opening orifice arranged in said ceiling of the compression chamber.

Also, the fuel transfer body is further provided with an outlet channel controlled by an outlet valve member, the outlet channel opening into the compression chamber through an outlet orifice arranged in said ceiling of the compression chamber.

Also, in the ceiling of the compression chamber, the outlet orifice and the inlet orifice are arranged next to each other.

Also, the inlet orifice and the inlet channel are coaxially aligned along the main axis.

Also, the outlet channel angularly A extends relative to the main axis.

Also, the pressurizing body is further provided with a counterbore formed at the opening end of the bore, portion of the bore defining the compression chamber, said counterbore forming a gallery in the ceiling of which open the inlet orifice and the outlet orifice.

Also, the pressurizing body has a cylindrical barrel shape extending along the main axis, said barrel being threaded on its peripheral outer face and screwed in a complementary threaded another bore provided in the fuel transfer body, the fuel transfer body sealing face being the bottom face of said another bore and, the pressurizing body sealing face being a transverse face of the barrel.

Also, the complementary threaded zones, of the pressurizing body and of the fuel transfer body end at a distance from the sealing faces, said another bore having in said distance a larger diameter than the outer diameter of pressurizing body so that a peripheral annular gap is defined between the fuel transfer body and the pressurizing body.

BRIEF DESCRIPTION OF THE DRAWINGS

The present invention is now described by way of example with reference to the accompanying drawings in which.

DESCRIPTION OF THE PREFERRED EMBODIMENTS

Figure 1:
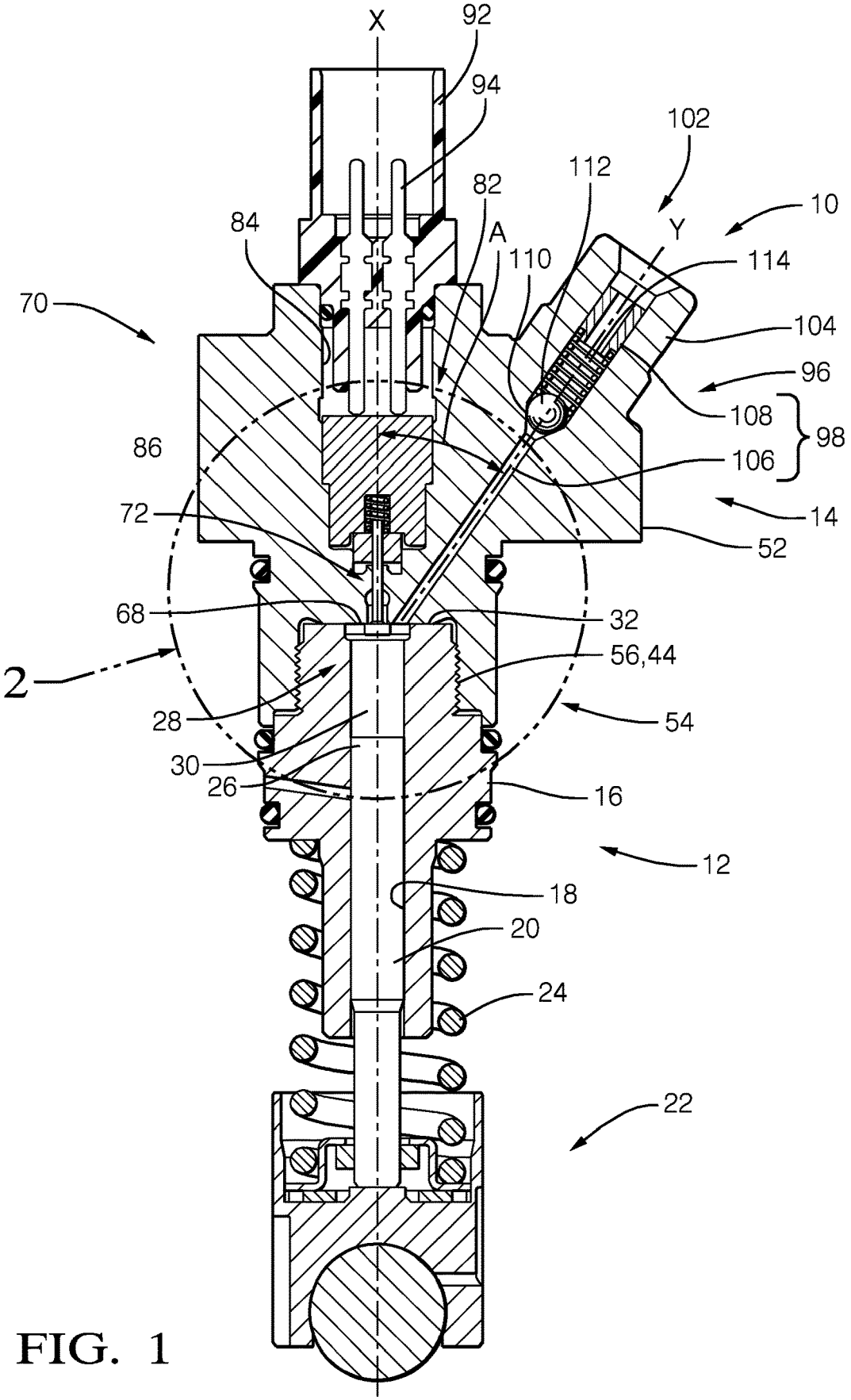
FIG. 1 is an axial section of a high pressure pump as per the invention.

In reference to the figures is described a high pressure pump 10 of a diesel fuel injection equipment, wherein in use, diesel fuel F can be pressurized at a high pressure, prior to be delivered to the common rail.

The pump 10 is a cam actuated pump comprising the complementary arrangement of a pressurizing assembly 12 and a fuel transfer assembly 14. Following the arbitrary top-down orientation of FIG. 1, the pressurizing assembly 12, in the bottom part, comprises a pressurizing body 16 provided with a pumping bore 18 extending along a main axis X and opening at both ends of the pressurizing body 16. In the bore 18 is slidably arranged a plunger 20 adapted to translate along said main axis X and, at the bottom end of the plunger is arranged a cam follower assembly 22 pushed away from the pressurizing body 16 by a pump spring 24 compressed between the cam follower assembly 22 and a face of the pressurizing body 16. The top end 26 of the plunger and the top extremity 28 of the bore define a compression chamber 30 which volume is varied as the plunger 20 translates and performs a pumping cycle.

Figure 2:
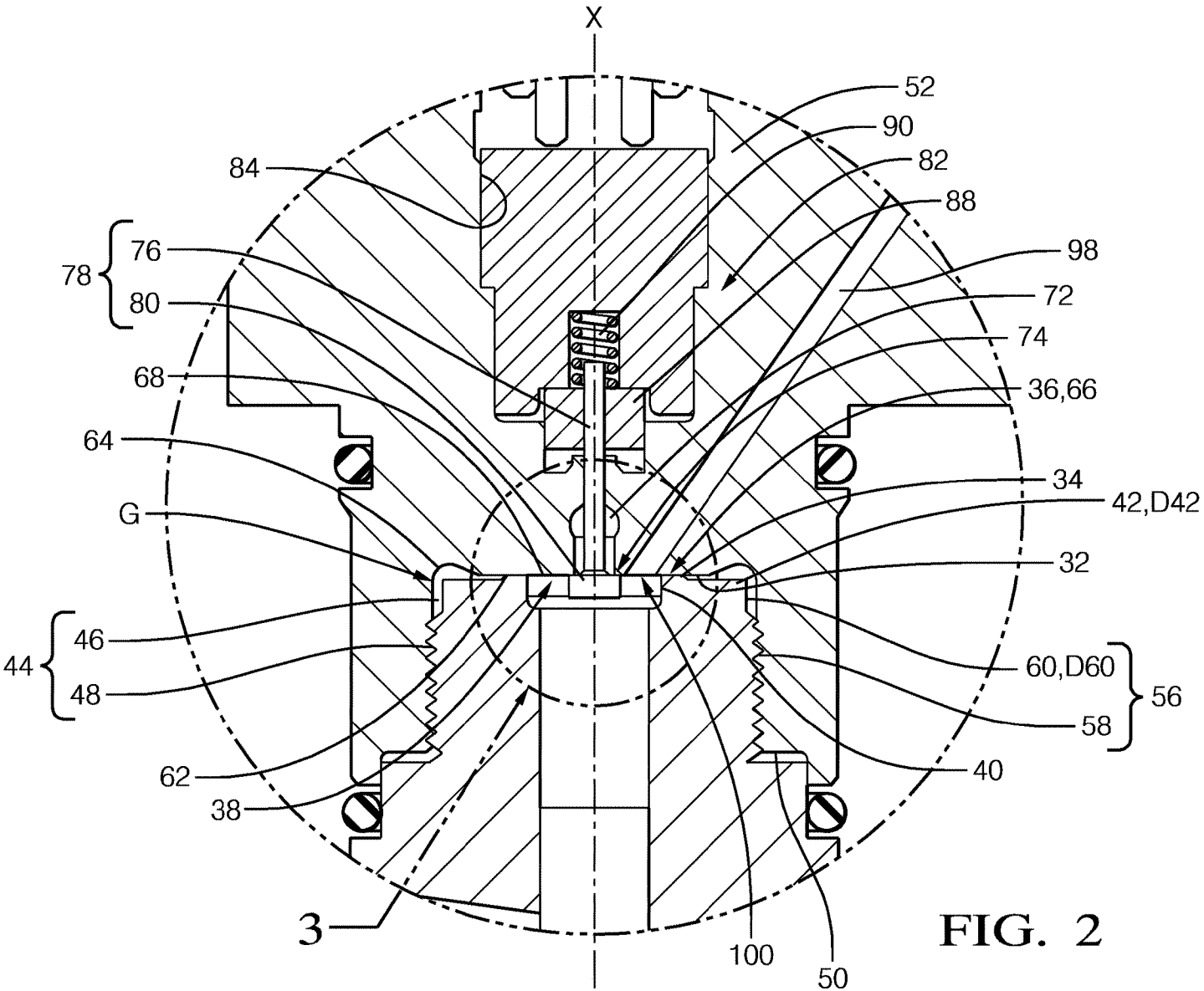
FIG. 2 is a magnified zone of the pump of FIG. 1.
Figure 3:
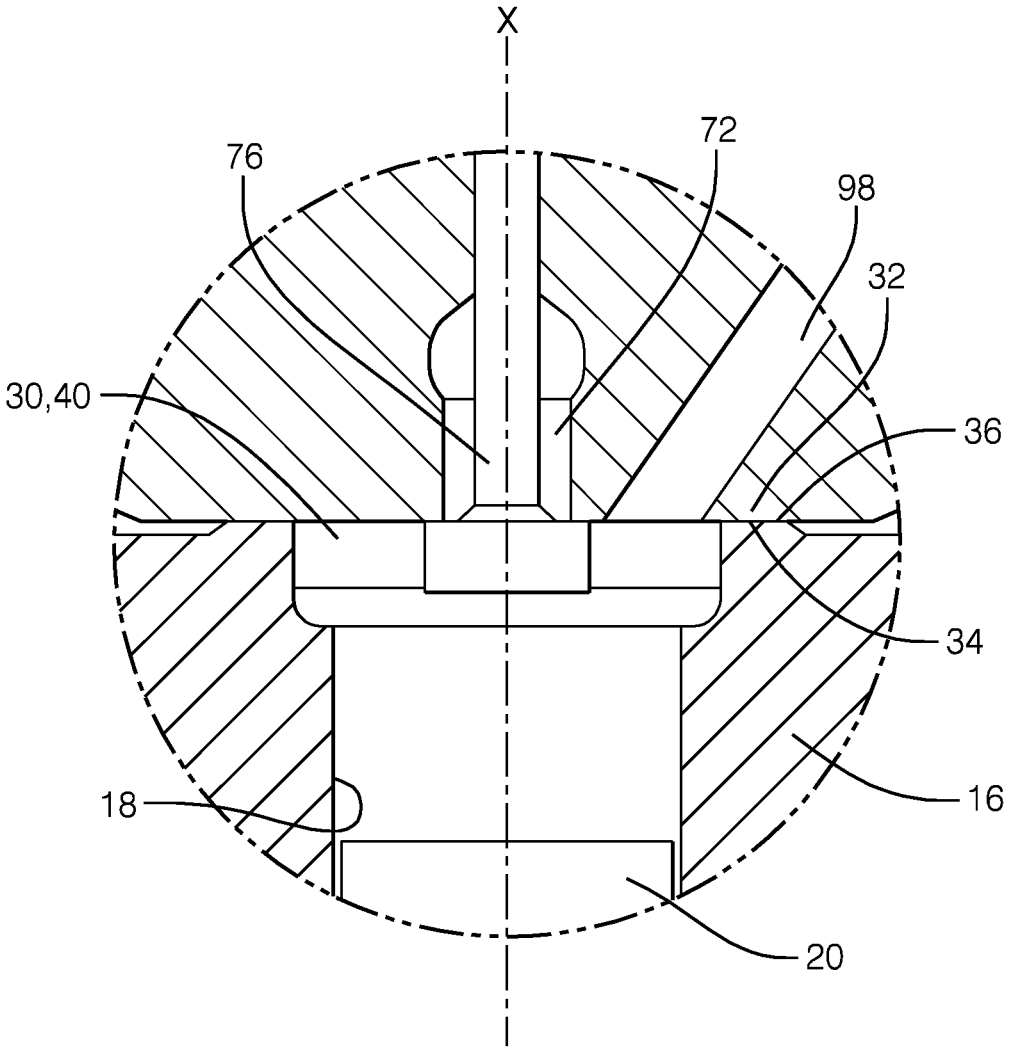
FIG. 3 is a focus on the compression chamber of the pump of FIG. 1.

More precisely, in the top part of the pressurizing body 16 the pumping bore 18 opens in an upper transverse face 32 of said pressurizing body 16, said transverse face 32 being provided with a sealing interface 34 having a narrow tip face 36, better visible on FIG. 2 or 3, said sealing interface 34 slightly rising above the transverse face 32 and surrounding the opening 38 of the bore.

Also, at the opening end of the bore is arranged a counterbore 40 enlarging the very end portion of the bore 18 and forming a gallery 40 in the pressurizing body.

Further describing the pressurizing assembly 12, the upper transverse face 32 radially extends to a peripheral edge 42 having a diameter D42 from which axially X extends a lateral face 44 divided in an upper cylindrical portion 46, in the vicinity of the edge 42 and, a lower male threaded portion 48 downwardly extending to a shoulder face 50.

The fuel transfer assembly 14 is the top part of the pump 10 and it comprises a fuel transfer body 52 having a connecting part for complementary arrangement with the pressurizing body 16, said connecting part being the lower cylindrical part 54 of said body comprising a larger female cylindrical bore 56 divided in a lower female threaded portion 58 and an upper cylindrical portion 60 of diameter D60. Said another bore 56 has a bottom transverse face 62 radially extending to join the upper cylindrical portion 60 in a fillet radius 64 that is normally provided to avoid contact and damage of the peripheral edge 42. Alternatively to said fillet radius, a chamber could cut the circular peripheral edge 42.

As shown on the figures, the complementary arrangement of the fuel transfer body 52 onto the pressurizing assembly 12 is done by tightly threading the pressurizing body 16 in said another bore 56, the upper cylindrical portion 46 of the pressurizing body engaging in the female cylindrical portion 60 of the fuel transfer body, defining between said cylindrical portions 46, 60, an annular gap G. In said arrangement the tip face 36 of the sealing interface of the upper transverse face of the pressurizing body comes in firm pressure contact against the bottom transverse face 62 of the fuel transfer body and defines a sealing area 66, sealingly closing the compression chamber 30.

In a non-represented alternative, the pressurizing body 16 can be arranged in sealing facial contact against a bottom face 62 of the fuel transfer body 52, said arrangement being secured by a cap nut which, similarly as the cap nut maintaining the integrity of a fuel injector, would be engaged around the pressurizing body 16 abutting on a shoulder face of said body and extending toward the transfer body 52 on which it would be screwed.

The enclosure of the compression chamber 30 is now defined by a floor formed by the top end 26 of the plunger, a lateral cylindrical wall formed by top extremity 28 of the bore 18 and also the counterbore 40 and now by a ceiling 68 formed by the portion of the transverse face 62 that is inside the sealing interface 34, right above the plunger 20.

Inside the fuel transfer body 52 is arranged an inlet valve assembly 70 comprising an inlet channel 72 extending along the main axis X and having an opening orifice 74 in the centre of the ceiling 68 of the compression chamber. The inlet valve assembly 70 further comprises a poppet inlet valve member 76 having a stem 78 at a bottom end of which is a head member 80, the stem 78 extending along the main axis X and the head protruding in the gallery 40 controlling the opening orifice 74 of the inlet channel 72. Said poppet inlet valve 76 cooperates with an actuator assembly 82 which, upwardly attracts said inlet valve 76 toward a closed position CPI of the opening orifice 74 when being energized and, downwardly push the valve toward an open position OPI of said opening orifice 74 when not being energized.

More precisely, the fuel transfer body 52 is further provided with a cylindrical well 84 upwardly opening in the upper face of the fuel transfer body 52 and axially X extending toward a bottom where opens the inlet channel 72, the upper end of the stem 78 protruding in said bottom of said well 84.

The actuator assembly 82 is an electromagnetic actuator comprising a solenoid 86 axially arranged and fixed at the bottom of the well 84, a magnetic armature 88 is fixed to the stem of the inlet valve member and is attracted by the solenoid 86 when it is energized. A valve spring 90 compressed against said armature bias the inlet valve member away from the solenoid when this latter one is not energized.

An electrical connector 92 arranged above the solenoid 86 is closing the well 84 and, electrical pins 94 extending from said connector 92 to the solenoid 86 enable to energize the solenoid 86.

As can be observed on FIG. 1, the pump bodies, the pumping bore 18, the plunger 20, the compression chamber 30, the gallery 40, the inlet channel 72, the poppet inlet valve member 76, the actuator assembly 82, the well 84 and the connector 92 are all aligned along the main axis X, this alignment having important advantages detailed below.

The fuel transfer body 52 further accommodates an outlet valve assembly 96 comprising an outlet channel 98 extending in the fuel transfer body 52 from an opening 100 arranged in the ceiling 68 of the compression chamber to an outside aperture 102 opening at the end of a threaded turret 104 of the fuel transfer body, the turret being adapted to connect to a high pressure pipe not represented.

Here, is understood that the gallery 40 previously introduced is an alternative construction since, as long as the sealing interface 34 externally surrounds the opening 74 of the inlet and the opening 100 of the outlet, such gallery is not mandatory.

The outlet channel 98 comprises an inner narrow portion 106 and an outer larger portion 108, the two portions 106, 108, being united via a conical seating face 110 against which a ball member 112 is biased by a spring 114 compressed in said outer portion 108. This arrangement of a ball, or outlet valve member, spring and conical seating face forms a known one-way check valve only opening the outlet channel 98 when the pressure in the inner portion 106 as reached a predetermined threshold superior to the pressure in the outer portion 108 and the compression force of the spring 114. Alternative constructions of the outlet valve assembly 96 exist for instance where the channel comprises several segments not aligned.

Furthermore, as visible on the figures, the outlet channel extends along an outlet axis Y that makes with the main axis X an angle A which, in FIG. 1 is substantially 35°. Other angles can be accommodated depending on the outlet position required. Also, in the ceiling 68 of the compression chamber, the inlet opening orifice 74 is centred and, the outlet opening 100 is slightly radially shifted right next to the inlet opening.

Another advantage of the embodiment presented is the simplicity of manufacturing and assembly. Indeed, the pressurizing body 16 directly assembles into the fuel transfer body 52 without requiring the need of nuts or flanges or any additional third part that would maintain the parts together. Furthermore, this simplicity is further enabled since the fuel transfer body 52 is a unique integral part in which are provided both the inlet 70 and the outlet 96 valve assemblies.

The general operation of the pump 10 has already been raised but is now summarized.

When the engine rotates the cam follower 22 imparts to the plunger 20 reciprocal axial displacement of a pumping cycle, said displacements extending between a bottom dead centre BDC position, where the internal volume of the compression chamber 30 is maximum and, a top dead centre TDC position where the internal volume of the compression chamber 30 is minimal. A complete pumping cycle is defined as follow:

In a first stage, the plunger 20 downwardly moves from TDC to BDC, the solenoid 86 is not energized, the inlet valve member 76 is in open position OPI, the outlet channel 98 is closed, the ball 112 is biased by the spring 114 against the seating face 110. Fresh fuel F drawn by said downward displacement of the plunger enters the compression chamber 30 via the inlet channel.

In a second stage, the plunger upwardly moves from BDC to TDC, the solenoid 86 is energized and the inlet valve member 76 moves to the closed position CPI.

When initiating said upward displacement, the outlet channel 98 remains closed and, the fuel F in the compression chamber 30 gets pressurized.

During said upward displacement, the pressure in the compression chamber 30 reaches a threshold which pushes the ball 112 in an open position enabling the pressurized fuel to exit the compression chamber 30 and to flow out via the outlet channel 98.

During this second stage of the pumping cycle, internal mechanical hoop stresses rise in the outlet channel 98 and in the pumping bore 18. The aligned architecture presented, and the compression of two components together, reduces the amount that the hoop stresses combine. As the hoop stresses are not present in the same part, they are not able to interact, and the two surfaces are able to slip against each other. The compression between the components also creates a field of compressive stress around the intersection that reduces the maximum and mean stresses. This allows the parts to be left in their heat treated state, without having to do any extra machining to radius the edges and take off the oxide layer that weakens the material strength.

In addition to avoidance of overstress areas, the alignment along the main axis X of the pressurizing body, the fuel transfer body, the pumping bore 18, the plunger 20, the inlet channel, the inlet valve member, the well 84 and, the angular orientation of the outlet channel ease the manufacturing and assembling processes of the pump.

Figure 4:
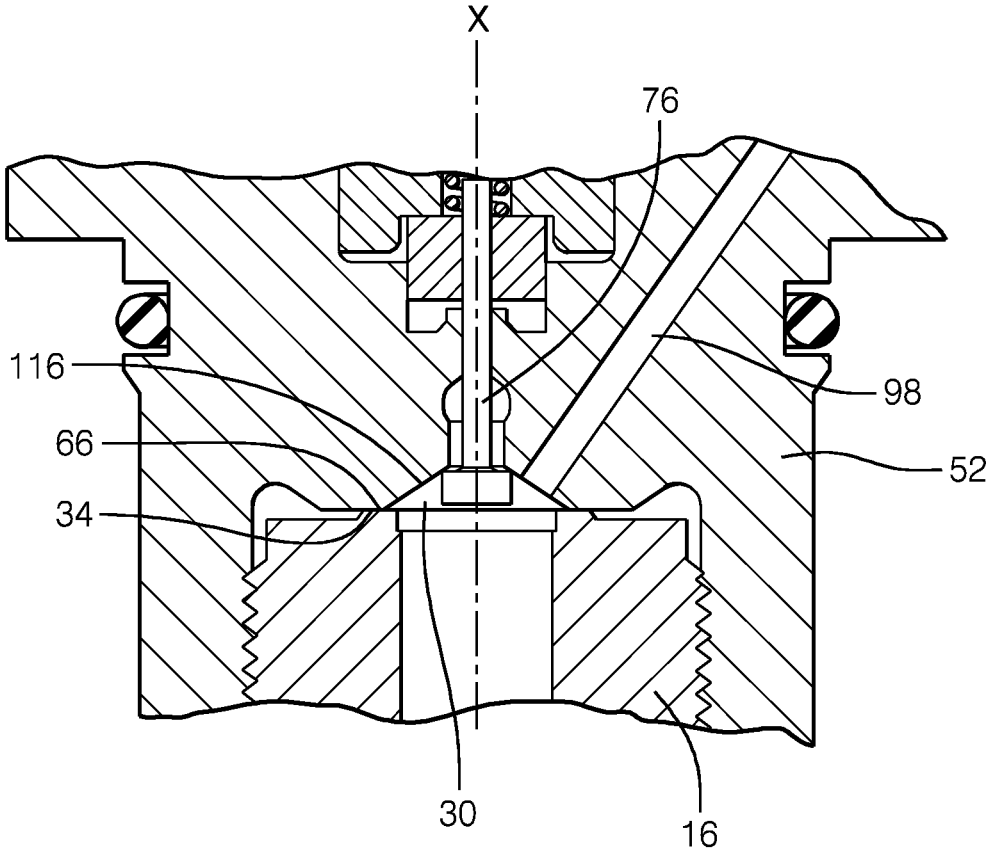
FIG. 4 is second embodiment of the pump as per the invention.

In a further alternative represented on FIG. 4, the chamber 30 arranged in the fuel transfer body 52 comprises a sloped face 116 downwardly extending from the surrounding of the inlet opening orifice 74, at the top, to the surrounding of the opening of the pumping bore 18, the larger section of said sloped face 116 being where the sealing interface 34 is. While the inlet valve assembly 70 remains axially X aligned, the outlet channel 98 opens in said sloped face 116.

Other non-represented embodiments can be arranged where said sloped face 116 has different inclination, the outlet opening 100 being arranged either in said sloped face or at a junction between two faces.

LIST OF REFERENCES

X main axis
Y outlet orifice
D42 diameter of the edge
D60 diameter of the cylindrical portion
G annular gap
CPI closed position of the inlet
OPI open position of the inlet
BDC bottom dead centre
TDC top dead centre
10 pump
12 pressurizing assembly
14 fuel transfer assembly
16 pressurizing body
18 pumping bore
20 plunger
22 cam follower assembly
24 spring
26 top end of the plunger
28 top extremity of the bore
30 compression chamber
32 upper transverse face of the pressurizing body
34 sealing interface
36 tip face of the lip seal
38 opening of the bore
40 counterbore—gallery
42 peripheral edge
44 lateral face of the pressurizing body
46 upper cylindrical portion
48 threaded portion of the pressurizing body
50 shoulder face
52 fuel transfer body
54 lower cylindrical part of the fuel transfer body
56 larger bore—another bore
58 threaded portion of the fuel transfer body
60 cylindrical portion of the lateral face of the bore
62 bottom transverse face
64 fillet radius
66 sealing area
68 ceiling of the compression chamber
70 inlet valve assembly
72 inlet channel
74 opening orifice of the inlet valve channel in the ceiling
76 poppet inlet valve member
78 stem of the poppet valve
80 head of the poppet valve
82 actuator assembly
84 well
86 solenoid
88 magnetic armature
90 valve spring
92 electrical connector
94 electrical pins
96 outlet valve assembly
98 outlet channel
100 opening of the outlet channel in the ceiling
102 outside aperture of the outlet channel
104 turret
106 inner narrow portion
108 outer larger portion
110 conical seating face
112 ball—outlet valve member
114 spring

116 sloped face

118 integral sub-assembly

The invention claimed is:

1. A high pressure fuel pump adapted to be arranged in a diesel fuel injection equipment, said high pressure fuel pump comprising:

a pressurizing assembly wherein a plunger arranged in a bore is adapted to translate along a main axis in order to vary volume of a compression chamber defined by an extremity of the bore and an extremity of the plunger and, a fuel transfer assembly comprising an inlet valve assembly controlling an inlet flow of low pressure fuel in said compression chamber and an outlet valve assembly controlling an outlet flow of pressurized fuel out of said compression chamber;

wherein the pressurizing assembly has a pressurizing body provided with the bore and the fuel transfer assembly has a fuel transfer body wherein are arranged the inlet valve assembly and the outlet valve assembly, said pressurizing body and said fuel transfer body being distinct parts sealingly fixed to each other along a sealing area;

wherein the bore opens in the pressurizing body at the sealing area;

the fuel transfer body sealing closes the bore at the sealing area;

wherein the pressurizing body is further provided with a counterbore formed in the bore at the sealing area and defining the compression chamber, the counterbore forming a gallery into which open an inlet orifice from the inlet valve assembly and an outlet orifice to the outlet valve assembly;

wherein said sealing area is a compressed surface defined between a pressurizing body sealing face and a fuel transfer body sealing face, at least one of said pressurizing body sealing face and said fuel transfer body sealing face being provided with a sealing interface forming a protrusion raising above said at least one of said pressurizing body sealing face and said fuel transfer body sealing face, a tip of said sealing interface defining the sealing area; and wherein the pressurizing body has a cylindrical barrel shape extending along the main axis, said cylindrical barrel shape being threaded on a peripheral outer face thereof and screwed in a complementary threaded another bore provided in the fuel transfer body, the fuel transfer body sealing face being a bottom face of said another bore and, the pressurizing body sealing face being a transverse face of the cylindrical barrel shape.

2. A high pressure fuel pump as claimed in claim 1, wherein, the fuel transfer body sealing face, the pressurizing body sealing face, and the resulting sealing area are planar and perpendicular to the main axis.

3. A high pressure fuel pump as claimed in claim 1, wherein the compression chamber has a cylindrical peripheral wall defined by and end portion of the bore at the pressurizing body sealing face and the compression chamber also has a ceiling defined by the fuel transfer body sealing face closing the opening of the bore, the sealing area being defined at the cylindrical peripheral wall.

4. A high pressure fuel pump as claimed in claim 3, wherein the fuel transfer body is provided with an inlet channel controlled by an inlet valve member, the inlet channel opening into the compression chamber through the inlet opening orifice arranged in said ceiling of the compression chamber.

5. A high pressure fuel pump as claimed in claim 4, wherein the fuel transfer body is further provided with an outlet channel controlled by an outlet valve member, the outlet channel opening into the compression chamber through the outlet orifice arranged in said ceiling of the compression chamber.

6. A high pressure fuel pump as claimed in claim 5, wherein in the ceiling of the compression chamber, the outlet orifice, and the inlet orifice are arranged next to each other.

7. A high pressure fuel pump as claimed in claim 5, wherein the bore, the inlet orifice, and the inlet channel are coaxially aligned along the main axis.

8. A high pressure fuel pump as claimed claim 5, wherein the outlet channel angularly extends relative to the main axis.

9. A high pressure fuel pump as claimed in claim 1, wherein a complementary threaded zone of the pressurizing body and of the fuel transfer body end at a distance from the pressurizing body sealing face and the fuel transfer body sealing face, said another bore having in said distance a larger diameter than an outer diameter of pressurizing body so that a peripheral annular gap is defined between the fuel transfer body and the pressurizing body.

* * * * *